US005839524A

United States Patent [19]

Sanford

[11] Patent Number: 5,839,524

[45] Date of Patent: Nov. 24, 1998

[54] QUICK RELEASE LOCKING DRILL ROD AND ASSEMBLY

[76] Inventor: Paul C. Sanford, P.O. Box 1071, Elbow Lake, Minn. 56531

[21] Appl. No.: 859,978

[22] Filed: May 21, 1997

[51] Int. Cl.[6] ..... E21B 17/02

[52] U.S. Cl. ..... 175/320; 166/360

[58] Field of Search ..... 175/320, 325.2; 166/341, 360

[56] References Cited

U.S. PATENT DOCUMENTS

| | | | |
|---|---|---|---|
| 305,140 | 9/1884 | Bradley . | |
| 526,097 | 9/1894 | Anderson . | |
| 2,650,664 | 9/1953 | Sorensen | 166/12 |
| 2,736,384 | 2/1956 | Potts | 166/220 |
| 2,918,259 | 12/1959 | Le Bus, Sr. | 255/28 |
| 3,097,001 | 7/1963 | Le Bus, Sr. | 285/361 |
| 3,248,129 | 4/1966 | Brown | 175/320 X |
| 3,345,826 | 10/1967 | Hignite | 175/320 X |
| 3,390,897 | 7/1968 | Moore | 285/33 |
| 3,575,446 | 4/1971 | Brantley et al. | 285/85 |
| 3,869,218 | 3/1975 | Stoeber et al. | 403/241 |
| 4,306,743 | 12/1981 | Hinshaw et al. | 285/260 |
| 4,611,662 | 9/1986 | Harrington | 175/320 X |
| 4,661,009 | 4/1987 | Tripp | 403/349 |
| 4,768,588 | 9/1988 | Kupsa | 175/320 X |
| 5,050,691 | 9/1991 | Moses | 175/320 X |
| 5,086,843 | 2/1992 | Mims et al. | 175/320 X |
| 5,551,797 | 9/1996 | Sanford | 405/36 |

*Primary Examiner*—Frank Tsay
*Attorney, Agent, or Firm*—John K. Flanagan; John R. Flanagan; Flanagan & Flanagan

[57] ABSTRACT

A quick release locking drill rod includes a hollow sleeve having opposite first and second end portions and components for quick release locking the first end portion of the sleeve of one rod to the second end portion of the sleeve of another rod. The first end portion of the sleeve of one rod receives therein the second end portion of the sleeve of another rod. The quick release locking components connect the first end portion of the sleeve of one rod to the second end portion of the sleeve of another rod and include an internal cross pin and pair of diametrically opposed L-shaped slots. The internal cross pin is disposed in the first end portion of the sleeve and is spaced inwardly from the open first end. The internal cross pin spans the first diameter and has opposite ends attached to opposite sides of the first end portion of the sleeve. The diametrically opposed L-shaped slots are defined in respective opposite sides of the second end portion of the sleeve. The L-shaped slots of the sleeve of one rod releasably retain the internal cross pin of the sleeve of another rod upon insertion of the internal cross pin into and rotation of the internal cross pin within the L-shaped slots of the sleeve of the one rod.

17 Claims, 1 Drawing Sheet

QUICK RELEASE LOCKING DRILL ROD AND ASSEMBLY

BACKGROUND OF THE INVENTION

1. Field of the Invention

The present invention generally relates to drill rods used in forming underground passageways and, more particularly, is concerned with a drill rod having a quick release locking connection feature and an assembly of such drill rods.

2. Description of the Prior Art

Water can accumulate below the surface of the ground under a floor slab of a basement and around a foundation of a building. A variety of water drainage systems have been developed over the years to protect buildings from this problem. One approach, developed by and disclosed in U.S. Pat. No. 5,551,797 to Paul C. Sanford of Elbow Lake, Minn., the applicant herein, involves retrofitting an underground water drainage sump system for protecting a floor slab and which is also applicable to sub-slab depressurization for removal of polluting gases from a building.

The retrofitting method comprises the steps of: (a) forming a sump hole through and below the floor slab; (b) forming a plurality of lateral passageways below and extending outwardly to the vicinity of an outer perimeter of the floor slab; (c) inserting a plurality of perforated hollow collection pipes into the lateral passageways and manifolding the pipes into the sump hole; and (d) placing a sump pump into the sump hole for pumping drainage water from the sump hole. The step involving the formation of a plurality of lateral passageways generally requires the use of an underground drilling tool.

A variety of underground drilling tools have been developed over the years. Representative examples of these prior art underground drilling tools and the like are disclosed in U.S. Pat. No. 305,140 to Bradley, U.S. Pat. No. 526,097 to Anderson, U.S. Pat. No. 2,650,664 to Sorensen, U.S. Pat. No. 2,736,384 to Potts, U.S. Pat. Nos. 2,918,259 and 3,097,001 to Le Bus, Sr., U.S. Pat. No. 3,390,897 to Moore, U.S. Pat. No. 3,575,446 to Brantley et al., U.S. Pat. No. 3,869,218 to Stoeber et al. and U.S. Pat. No. 4,306,743 to Hinshaw et al. Common features in these prior art underground drilling tools include a sleeve and locking means disposed on the sleeve for interlocking a series of like sleeves into a string. The locking means includes interlocking projections and grooves. Furthermore, at least one of these prior art underground drilling tools has diametrically disposed slots and opposite lugs. A problem exists, however, in that none of these prior art underground drilling tools appears to provide a means for securing and releasing sleeves to and from one another in an efficient manner and with optimum reliability while still providing for quick release and connection.

Consequently, a need still exists for a drill rod which provides a solution to the aforementioned problem in the prior art without introducing any new problems in place thereof.

SUMMARY OF THE INVENTION

The present invention provides a quick release locking drill rod and an assembly of drill rods designed to satisfy the aforementioned need. The quick release locking drill rod of the present invention includes a means for releasably securing multiple drill rods to and from one another in an efficient manner and with optimum reliability. An internal cross pin is disposed within each drill rod at one end thereof while a pair of diametrically opposed L-shaped slots are defined at the opposite end from the internal cross pin of each drill rod. The internal cross pin is for insertion into and rotation within the diametrically opposed L-shaped slots of an adjacent identical drill rod for releasably securing drill rods to one another. The internal cross pin and diametrically opposed L-shaped slots generally provide a more reliable, fail-safe means for securing and releasing the drill rods to and from one another.

Accordingly, the present invention is directed to a quick release locking drill rod which comprises: (a) a sleeve having opposite first and second end portions; and (b) means for quick release locking the first end portion of the sleeve of one rod to the second end portion of the sleeve of another rod. The first end portion of the sleeve has a first diameter and an open first end. The second end portion of the sleeve has a second diameter and an open second end. The first diameter is greater than the second diameter. The first end portion of the sleeve of one rod is for receiving the second end portion of the sleeve of another rod therein. The quick release locking means connects the first end portion of the sleeve of one rod to the second end portion of the sleeve of another rod. The quick release locking means includes an internal cross pin and pair of diametrically opposed L-shaped slots. The internal cross pin is disposed in the first end portion of the sleeve and is spaced inwardly from the open first end and extends the first diameter thereof. The internal cross pin has opposite ends attached to opposite sides of the first end portion of the sleeve. The diametrically opposed L-shaped slots are defined in respective opposite sides of the second end portion of the sleeve. The diametrically opposed L-shaped slots of the quick release locking means of the sleeve of one rod is for releasably retaining the internal cross pin of the quick release locking means of the sleeve of another rod upon insertion of the internal cross pin into and rotation of the internal cross pin within the diametrically opposed L-shaped slots of the quick release locking means of the sleeve of the one rod.

More particularly, each of the diametrically opposed L-shaped slots of the quick release locking means has an access channel portion and a lock channel portion. The access channel portion extends lengthwise of and inwardly from the open second end of the second end portion of the sleeve. The access channel portion is defined by a pair of spaced opposite first and second edges. The first edge extends a shorter distance than the second edge into the side of the second end portion of the sleeve. The lock channel portion is spaced inwardly from the open second end of the second end portion of the sleeve and circumferentially extends in transverse relation to the access channel portion. The lock channel portion of one of the diametrically opposed L-shaped slots on one side of the second end portion extends in an opposite circumferential direction from the lock channel portion of the other of the diametrically opposed L-shaped slots on the opposite side of the second end portion therefrom. The lock channel portion is defined by a pair of spaced opposite third and fourth edges. The third edge extends from an internal end of the first edge of the access channel portion and the fourth edge extends from an internal end of the second edge of the access channel portion such that the lock channel portion intersects and communicates with the access channel portion. The third and fourth edges of the lock channel portion together form a round end stop for releasably retaining the internal cross pin in the the sleeve of one rod upon insertion of the internal cross pin into and upon rotation of the internal cross pin within the diametrically opposed L-shaped slots on the second end portion of the sleeve of another rod.

The present invention also is directed to a quick release locking drill rod assembly wherein the sleeves of the rods are connected to one another to form a string thereof. The quick release locking drill rod assembly can have any suitable length. A rod is rarely used alone and is generally used as one of a series of like rods to form the string such that the quick release locking means can be utilized.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
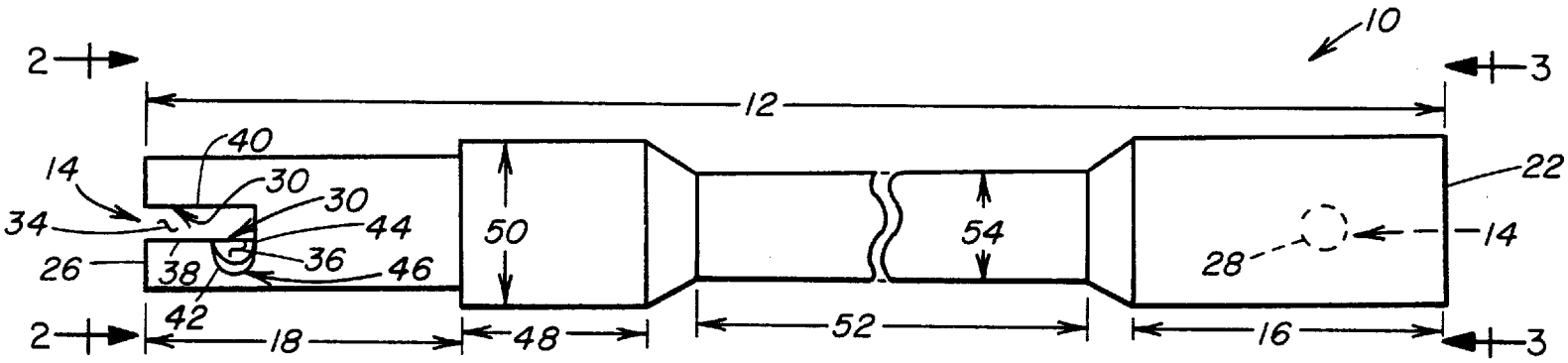
FIG. 1 is a foreshortened side elevational view of a quick release locking drill rod of the present invention.
Figure 3:
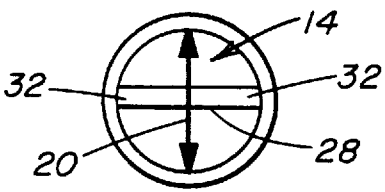
FIG. 3 is an opposite end elevational view of the quick release locking drill rod taken along line 3—3 of FIG. 1.
Figure 2:
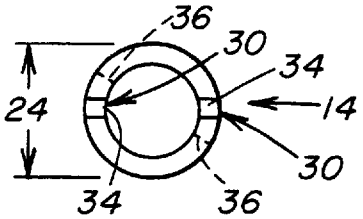
FIG. 2 is an end elevational view of the quick release locking drill rod taken along line 2—2 of FIG. 1.

Referring to the drawings and particularly to FIGS. 1 to 3, there is illustrated a quick release locking drill rod, generally designated 10, of the present invention. Basically, the quick release locking drill rod 10 includes a hollow sleeve 12 and quick release locking means 14. The sleeve 12 has opposite first and second end portions 16, 18. The first end portion 16 has a first inside diameter 20 and an open first end 22. The second end portion 18 has a second outside diameter 24 and an open second end 26. The first inside diameter 20 is greater than the second outside diameter 24. As can be observed and thus understood in FIG. 4, the first or male end portion 16 of the sleeve 12 of one rod 10 is adapted to receive the second or female end portion 18 of the sleeve 12 of another rod 10 therein.

The quick release locking means 14 connects the first end portion 16 of the sleeve 12 of one rod 10 to the second end portion 18 of the sleeve 12 of another rod 10. More particularly, the quick release locking means 14 includes an internal cross pin 28 and a pair of diametrically opposed L-shaped slots 30. The internal cross pin 28 is disposed in the first end portion 16 of the sleeve 12 and is spaced inwardly from the open first end 22 and spans or extends the first inside diameter 20 thereof. The internal cross pin 28 has opposite ends 32 fixedly attached to opposite sides of the first end portion 16 of the sleeve 12. The opposite ends 32 of the internal cross pin 28 are preferably welded to the opposite sides of the first end portion 16 of the sleeve 12 but may be attached thereto by any other suitable means. The diametrically opposed L-shaped slots 30 are defined in respective opposite sides of the second end portion 18 of the sleeve 12. The diametrically opposed L-shaped slots 30 in the sleeve 12 of one rod 10 are for releasably retaining the internal cross pin 28 of the of the sleeve 12 of another rod 10 upon insertion of the internal cross pin 28 into and rotation thereof within the diametrically opposed L-shaped slots 30 of the sleeve 12 of the one rod 10.

Each of the diametrically opposed L-shaped slots 30 has an access channel portion 34 and a lock channel portion 36. The access channel portion 34 extends lengthwise of and inwardly from the open second end 26 of the second end portion 18 of the sleeve 12. The access channel portion 34 is defined by a pair of spaced opposite first and second edges 38, 40. The first edge 38 extends a shorter distance than the second edge 40 from the open second end 26 into the side of the second end portion 18 of the sleeve 12. The lock channel portion 36 is spaced inwardly from the open second end 26 of the second end portion 18 and circumferentially extends in transverse relation to the access channel portion 34. Also, the lock channel portion 36 of one of the diametrically opposed L-shaped slots 30 on one side of the second end portion 18 extends in an opposite circumferential direction from the lock channel portion 36 of the other of the diametrically opposed L-shaped slots 30 on the opposite side of the second end portion 18 therefrom. The lock channel portion 36 is defined by a pair of spaced opposite third and fourth edges 42, 44. The third edge 42 extends from an internal end of the first edge 38 of the access channel portion 34 and the fourth edge 44 extends from an internal end of the second edge 40 of the access channel portion 34 such that the lock channel portion 36 intersects and communicates with the access channel portion 34. The third and fourth edges 42, 44 of the lock channel portion 36 together form a round end stop 46 for releasably retaining the internal cross pin 28 of the sleeve 12 of one rod 10 upon insertion of the internal cross pin 28 into and upon rotation of the internal cross pin 28 within the diametrically opposed L-shaped slots 30 of the second end portion 18 of the sleeve 12 of another rod 10. The first or male end portion 16 of the sleeve 12 of one rod 10 is rotated clockwise about one-quarter of a turn within the second or female end portion 18 of the other rod 10 to lock the rods 10 to one another and is rotated counterclockwise about one-quarter of a turn within the second end portion 18 of the other rod 10 to unlock the rods 10 from one another. The directions of rotation, however, can be reversed.

The sleeve 12 further has a collar 48 spaced inwardly from the open second end 26 of and integrally formed around the second end portion 18 thereof. The collar 48 has a third outside diameter 50 substantially similar to the first outside diameter 20 of the first end portion 16 of the sleeve 12. The collar 48 extends lengthwise along the sleeve 12 a shorter distance than the length of the first end portion 16 of the sleeve 12. The collar 48 of the sleeve 12 of one rod 10 is intended to be disposed adjacent to the first end portion 16 of the sleeve 12 of another rod 10 when the rods 10 are connected to one another, as can be seen in FIG. 4.

The sleeve 12 further has a middle portion 52 which is disposed between the first and second end portions 16, 18. The middle portion 52 has a fourth diameter 54 which is substantially similar to the second diameter 24 of the second end portion 18 of the sleeve 12 and is reduced as compared to both the first diameter 20 of the first end portion 16 and the third diameter 50 of the collar 48 so as to reduce the amount of frictional contact between the earth and the exterior of the rod 10. The middle portion 52 generally is the longest portion of the sleeve 12 and may extend any suitable length.

Figure 4:
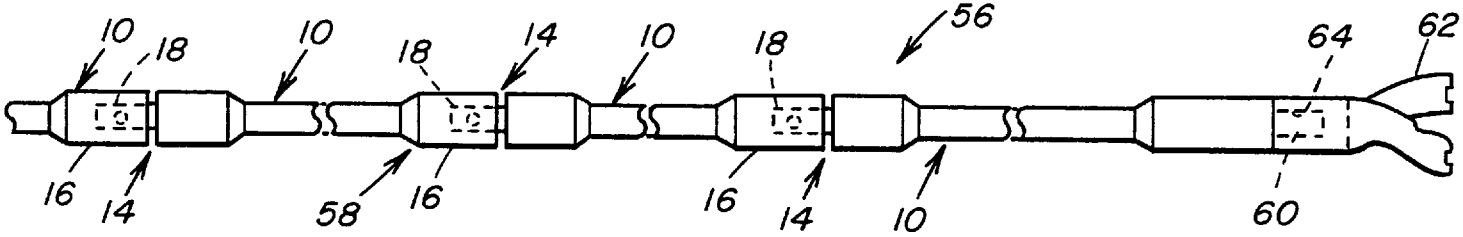
FIG. 4 is a foreshortened side elevational view of a quick release locking drill rod assembly of the present invention on a reduced scale and showing a cutter head attached at one end.

Referring now to FIG. 4, a plurality of the generally identical rods 10 can be connected end to end into an assembly to provide a string 56 of the sleeves 12 of the rods 10 connected to one another and together forming a quick release locking drill rod assembly 58, as shown particularly in FIG. 4. As described above, the joints formed by the quick release locking means 14 between successive pairs of rods 10 are assembled and disassembled independently of one another. The quick release locking drill rod assembly 58 can have any suitable length. A rod 10 is rarely used alone and is generally used as one of a series of like rods 10 to form the string 56 such that the quick release locking means 14 can be utilized. For the process of drilling, an externally threaded bolt 60 is attached to the first end portion 16 of a leading sleeve 12. A cutter head 62 having an internally threaded bore 64 is then threadably attached to the externally threaded bolt 60 and thereby provides a leading cutting means for the rod 10 and/or for the assembly 58.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A quick release locking drill rod, comprising:

(a) a sleeve having opposite first and second end portions, said first end portion having a first diameter and an open first end, said second end portion having a second diameter and an open second end, said first diameter being greater than said second diameter, said first end portion of said sleeve of one said rod being for receiving said second end portion of said sleeve of another said rod therein; and (b) means for quick release locking said first end portion of said sleeve of one said rod to said second end portion of said sleeve of another said rod, said quick release locking means including (i) an internal cross pin disposed in said first end portion of said sleeve and being spaced inwardly from said open first end and spaning said first diameter thereof, said internal cross pin having opposite ends attached to opposite sides of said first end portion of said sleeve, and (ii) a pair of diametrically opposed L-shaped slots defined in respective opposite sides of said second end portion of said sleeve, said pair of diametrically opposed L-shaped slots of said sleeve of one said rod adapted for releasably retaining said internal cross pin of said sleeve of another said rod upon insertion of said internal cross pin into and rotation of said internal cross pin within said pair of diametrically opposed L-shaped slots of said sleeve of said one rod.

2. The rod of claim 1 wherein said opposite ends of said internal cross pin are welded to the opposite sides of said first end portion of said sleeve.

3. The rod of claim 1 wherein each of said pair of diametrically opposed L-shaped slots of said quick release locking means includes:

an access channel portion extending lengthwise of and inwardly from said open second end of said second end portion of said sleeve, said access channel portion being defined by a pair of spaced opposite first and second edges, said first edge extending a shorter distance than said second edge into the side of said second end portion of said sleeve; and a lock channel portion spaced inwardly from said open second end of said second end portion of said sleeve and circumferentially extending in transverse relation to said access channel portion, said lock channel portion of one of said pair of diametrically opposed L-shaped slots on one side of said second end portion extending in an opposite circumferential direction from said lock channel portion of the other of said pair of diametrically opposed L-shaped slots on the opposite side of said second end portion therefrom, said lock channel portion defined by a pair of spaced opposite third and fourth edges, said third edge extending from an internal end of said first edge of said access channel portion and said fourth edge extending from an internal end of said second edge of said access channel portion such that said lock channel portion intersects and communicates with said access channel portion, said third and fourth edges of said lock channel portion together forming a round end stop for releasably retaining said internal cross pin of said sleeve of one said rod upon insertion of said internal cross pin into and upon rotation of said internal cross pin within said pair of diametrically opposed L-shaped slots of said second end portion of said sleeve of another said rod.

4. The rod of claim 1 wherein said sleeve further has a collar spaced inwardly from said open second end of and integrally formed around said second end portion thereof.

5. The rod of claim 4 wherein said collar of said sleeve has a third diameter substantially similar to said first diameter of said first end portion of said sleeve.

6. The rod of claim 1 wherein said sleeve further has a middle portion disposed between said first and second end portions, said middle portion having a fourth diameter substantially similar to said second diameter of said second end portion of said sleeve.

7. A quick release locking drill rod assembly, comprising:

(a) at least two rods each including a sleeve having opposite first and second end portions, said first end portion having a first diameter and an open first end, said second end portion having a second diameter and an open second end, said first diameter being greater than said second diameter, said first end portion of said sleeve of one said rod being for receiving said second end portion of said sleeve of another said rod therein; and (b) means for quick release locking said first end portion of said sleeve of one said rod to said second end portion of said sleeve of another said rod, said quick release locking means including (i) an internal cross pin disposed in said first end portion of said sleeve and being spaced inwardly from said open first end and extending said first diameter thereof, said internal cross pin having opposite ends attached to opposite sides of said first end portion of said sleeve, and (ii) a pair of diametrically opposed L-shaped slots defined in respective opposite sides of said second end portion of said sleeve, wherein each of said pair of diametrically opposed L-shaped slots has an access channel portion extending lengthwise of and inwardly from said open second end of said second end portion of said sleeve, said access channel portion being defined by a pair of spaced opposite first and second edges, said first edge extending a shorter distance than said second edge into the side of said second end portion of said sleeve, and a lock channel portion spaced inwardly from said open second end of said second end portion of said sleeve and circumferentially extending in transverse relation to said access channel portion, said lock channel portion of one of said pair of diametrically opposed L-shaped slots on one side of said second end portion extending in an opposite circumferential direction from said lock channel portion of the other of said pair of diametrically opposed L-shaped slots on the opposite side of said second end portion therefrom, said lock channel portion defined by a pair of spaced opposite third and fourth edges, said third edge extending from an internal end of said first edge of said access channel portion and said fourth edge extending from an internal end of said second edge of said access channel portion such that said lock channel portion intersects and communicates with said access channel portion, said third and fourth edges of said lock channel portion together forming a round end stop for releasably retaining said internal cross pin of said quick release locking means of said sleeve of one said rod upon insertion of said internal cross pin into and upon rotation of said internal cross pin within said pair of diametrically opposed L-shaped slots of said second end portion of said sleeve of another said rod.

8. The rod of claim 7 wherein said opposite ends of said internal cross pin of said quick release locking means are welded to the opposite sides of said first end portion of said sleeve.

9. The rod of claim 7 wherein said sleeve further has a collar spaced inwardly from said open second end of and integrally formed around said second end portion thereof.

10. The rod of claim 9 wherein said collar of said sleeve has a third diameter substantially similar to said first diameter of said first end portion of said sleeve.

11. The rod of claim 7 wherein said sleeve further has a middle portion disposed between said first and second end portions, said middle portion having a fourth diameter substantially similar to said second diameter of said second end portion of said sleeve.

12. A quick release locking drill rod assembly, comprising:

(a) a plurality of sleeves each having opposite first and second end portions, said first end portion having a first diameter and an open first end, said second end portion having a second diameter and an open second end, said first diameter being greater than said second diameter, said first end portion of one of said plurality of sleeves being for receiving said second end portion of another of said plurality of sleeves therein so as to form a string of said plurality of sleeves connected to one another; and (b) means for quick release locking said first end portion of one of said plurality of sleeves to said second end portion of another of said plurality of sleeves, said quick release locking means including (i) an internal cross pin disposed in said first end portion of each of said plurality of sleeves and being spaced inwardly from said open first end and extending said first diameter thereof, said internal cross pin having opposite ends attached to opposite sides of said first end portion of one of said plurality of sleeves, and (ii) a pair of diametrically opposed L-shaped slots defined in respective opposite sides of said second end portion of each of said plurality of sleeves, said pair of diametrically opposed L-shaped slots for releasably retaining said internal cross pin of said one of said plurality of sleeves upon insertion of said internal cross pin into and rotation of said internal cross pin within said pair of diametrically opposed L-shaped slots of said second end portion of another of said plurality of sleeves.

13. The assembly of claim 12 wherein said opposite ends of said internal cross pin of said quick release locking means are welded to the opposite sides of said first end portion of one of said plurality of sleeves.

14. The assembly of claim 12 wherein each of said pair of diametrically opposed L-shaped slots of said quick release locking means includes:

an access channel portion extending lengthwise of and inwardly from said open second end of said second end portion of one of said plurality of sleeves, said access channel portion being defined by a pair of spaced opposite first and second edges, said first edge extending a shorter distance than said second edge into the side of said second end portion of said one of said plurality of sleeves; and a lock channel portion spaced inwardly from said open second end of said second end portion of one of said plurality of sleeves and circumferentially extending in transverse relation to said access channel portion, said lock channel portion of one of said pair of diametrically opposed L-shaped slots on one side of said second end portion extending in an opposite circumferential direction from said lock channel portion of the other of said pair of diametrically opposed L-shaped slots on the opposite side of said second end portion therefrom, said lock channel portion defined by a pair of spaced opposite third and fourth edges, said third edge extending from an internal end of said first edge of said access channel portion and said fourth edge extending from an internal end of said second edge of said access channel portion such that said lock channel portion intersects and communicates with said access channel portion, said third and fourth edges of said lock channel portion together forming a round end stop for releasably retaining said internal cross pin of said quick release locking means of one of said plurality of sleeves upon insertion of said internal cross pin into and upon rotation of said internal cross pin within said pair of diametrically opposed L-shaped slots of said second end portion of another of said plurality of sleeves.

15. The assembly of claim 12 wherein each of said plurality of sleeves further has a collar spaced inwardly from said open second end of and integrally formed around said second end portion thereof.

16. The assembly of claim 15 wherein said collar of each of said plurality of sleeves has a third diameter substantially similar to said first diameter of said first end portion of said plurality of sleeves.

17. The assembly of claim 16 wherein each of said plurality of sleeves further has a middle portion disposed between said first and second end portions, said middle portion having a fourth diameter substantially similar to said second diameter of said second end portion of said plurality of sleeves.

* * * * *